US005458272A

United States Patent [19]

Ward-Weber

[11] Patent Number: 5,458,272

[45] Date of Patent: Oct. 17, 1995

[54] PAPERBOARD DISPENSER HAVING SEPARATELY FORMED DRAWER

[75] Inventor: Christine E. Ward-Weber, Trevor, Wis.

[73] Assignee: Packaging Corporation of America, Evanston, Ill.

[21] Appl. No.: 266,723

[22] Filed: Jun. 27, 1994

[51] Int. Cl.[6] ..... B65D 5/72

[52] U.S. Cl. ..... 229/122.1; 229/221

[58] Field of Search ..... 229/122.1, 240, 229/221, 229, 122; 221/305

[56] References Cited

U.S. PATENT DOCUMENTS

| | | | |
|---|---|---|---|
| 1,645,771 | 10/1927 | Pillsbury | 229/122.1 X |
| 1,988,064 | 1/1935 | Wiemann | 229/122.1 |
| 2,556,707 | 6/1951 | Rendall et al. | 229/122.1 X |
| 2,676,746 | 4/1954 | Kellogg et al. | 229/122.1 X |
| 2,770,408 | 11/1956 | Lindberg | 229/122.1 |
| 3,161,341 | 12/1964 | Farquhar | 229/122.1 |
| 3,306,437 | 2/1967 | Nelson | 229/122.1 X |
| 3,910,486 | 10/1975 | Stone . | |
| 3,963,173 | 6/1976 | Stone . | |
| 4,141,449 | 2/1979 | Stone . | |
| 4,602,735 | 7/1986 | Aaron | 229/122 X |
| 4,732,315 | 3/1988 | Gunn . | |
| 4,773,542 | 9/1988 | Schillinger et al. . | |
| 4,986,420 | 1/1991 | Gunn et al. . | |
| 5,154,343 | 10/1992 | Stone . | |
| 5,161,734 | 11/1992 | Ruehl et al. . | |
| 5,236,123 | 8/1993 | Stone et al. . | |
| 5,265,799 | 11/1993 | Stone . | |

*Primary Examiner*—Allan N. Shoap
*Assistant Examiner*—Christopher J. McDonald
*Attorney, Agent, or Firm*—Arnold, White & Durkee

[57] ABSTRACT

A paperboard dispenser for holding multiple individual items comprises an outer container formed from a first unitary blank and a drawer formed from a second unitary blank. The outer container includes opposing front and back walls, opposing side walls bridging the front and back walls, and opposing top and bottom walls. The front wall includes an upper portion and a lower portion, and the lower portion is hingedly connected to the container. The drawer is movable between an initial closed position where the drawer is housed within the container and an open dispensing position, and the drawer is releasably maintained in the initial closed position. The drawer includes a front section having an outer surface attached to an inner surface of the lower portion of the front wall so that hingedly moving the lower portion causes the drawer to move from the initial closed position to the open position. The drawer further includes a pair of ears hingedly connected to opposing edges of the front section and extending into the container adjacent respective ones of the opposing side walls of the container.

16 Claims, 5 Drawing Sheets

PAPERBOARD DISPENSER HAVING SEPARATELY FORMED DRAWER

FIELD OF THE INVENTION

The present invention relates generally to paperboard cartons for dispensing individual items contained therein. More specifically, the present invention relates to a paperboard dispenser which is cost-effective and easy to manufacture.

BACKGROUND OF THE INVENTION

Paperboard dispensers are used to dispense multiple individual items, such as confectionery products (e.g., hard candy, gum, etc.), bulk products, or other dispensable items. Initially, the dispenser is filled with the individual items, closed, and transported to a store. At the store, the closed dispenser is opened and is typically placed on a store shelf or at the check-out counter so that customers may access and purchase one or more of the individual items contained therein. Alternatively, customers may purchase the closed dispenser with its contents so that it can be opened and accessed at home or elsewhere.

One type of prior art paperboard dispenser, shown in FIGS. 1–3, includes an outer container 10 having opposing front and back walls 12, 14, a pair of opposing side walls 16, 18, and opposing top and bottom walls 20, 22. The front wall 12 includes an upper portion 24 and a lower portion 26. Access to the individual items within the container 10 is provided by a drawer 28, whose hidden portions are shown by dotted lines in FIGS. 1–2. The drawer 28 has a rectangular front section 30 and a pair of opposing ears 32, 34 hingedly connected to respective opposing vertical edges of the front section 30 (FIG. 2). The inner surface of the lower portion 26 of the container front wall 12 is attached to the outer surface of the front section 30 of the drawer 28. The opposing ears 32, 34 of the drawer 28 extend into the interior of the outer container 10 adjacent the respective opposing side walls 16, 18 thereof.

Prior to initially opening the drawer 28, the drawer 28 is maintained in a closed position by means of perforations 36 between opposing vertical edges of the lower portion 26 of the container front wall 12 and respective adjacent vertical edges of the side walls 16, 18 and perforations 38 between an upper horizontal edge of the lower portion 26 and an adjacent lower edge of the upper portion 24 of the front wall 12. To open the drawer 28, these perforations 36, 38 are broken by punching out a punch tab 40 and pulling the lower front wall portion 26 and the drawer front section 30 outward relative to the remainder of the front wall 12. To permit the lower front wall portion 26 and the drawer front section 30 to hingedly move outward relative to the remainder of the front wall 12, the lower front wall portion 26 and the drawer front section 30 are provided with respective lower horizontal scores 42, 44 which are aligned with each other. As the drawer 28 hingedly moves about the lower horizontal scores 42, 44 to an open position, the opposing ears 32, 34 slide relative to the respective side walls 16, 18 of the outer container 10 and move with the drawer front section 30 toward the exterior of the container 10. The opposing ears 32, 34 prevent the individual items within the container 10 from spilling out of the container 10 while the drawer 28 is opened.

The foregoing type of paperboard dispenser is manufactured from a unitary, continuous paperboard blank illustrated in FIG. 3. The blank includes four main panels 50, 52, 54, and 56 hingedly connected to each other along parallel vertical score lines. The panel 50 corresponds to the side wall 16, the panel 52 corresponds to the front wall 12, the panel 54 corresponds to the side wall 18, and the panel 56 corresponds to the back wall 14 of the container 10. A top closure panel 58 with a top tuck flap 60 is hingedly connected to the upper horizontal edge of the front panel 52, and a pair of dust flaps 62, 64 are hingedly connected to the upper horizontal edges of the respective side panels 50, 54. The dust flaps 62, 64 and the top closure panel 58 with the top tuck flap 60 form the top wall 20 of the container 10.

An outer bottom closure panel 66 is hingedly connected to the lower horizontal edge of the front panel 52, and an inner bottom closure panel 68 is hingedly connected to the lower horizontal edge of the back panel 56. A pair of bottom closure flaps 70, 72 with respective glue tabs 74, 76 are hingedly connected to the lower horizontal edges of the respective side panels 50, 54. The outer and inner bottom closure panels 66, 68 and the pair of bottom flaps 70, 72 cooperate to form the bottom wall 22 of the container 10.

To form the drawer 28, a plurality of panels extend from the bottom closure panel 66. More specifically, a first panel 78, which has substantially the same shape and size as the bottom closure panel 66, is hingedly connected to the lower horizontal edge of the bottom closure panel 66. In the assembled dispenser in FIGS. 1–2, the first panel 78 is folded 180 degrees about the lower horizontal edge of the bottom closure panel 66 so that the inner surface (i.e., surface not shown in FIG. 3) of the first panel 78 opposes the inner surface of the bottom closure panel 66. A strip panel 80 is hingedly connected to the lower horizontal edge of the first panel 78. In the assembled dispenser, the inner surface of this strip panel 80 is attached to the inner surface of the lower front wall portion 26 below the horizontal score 42.

Referring back to FIG. 3, the lower horizontal edge of the strip panel 80 corresponds to the horizontal score 44, and a drawer panel 82 is hingedly connected to the strip panel 80 along this horizontal score 44. The drawer panel 82 corresponds to the front drawer section 30 so that in the assembled dispenser, the inner surface thereof is attached to the inner surface of the lower front wall portion 26. The ear panels 84, 86 are hingedly connected to opposing vertical edges of the drawer panel 82, and these ear panels 84, 86 correspond to the respective ears 32, 34 of the drawer 28.

A drawback of the foregoing prior art dispenser depicted in FIGS. 1–3 is that it is cost-ineffective and relatively difficult to manufacture. In particular, during the manufacturing process, die-cutting equipment cuts and scores a sheet of paperboard to simultaneously produce a plurality of identical unitary blanks each having the configuration illustrated in FIG. 3. The number of simultaneously-produced blanks is limited by the cutting area employed by the die-cutting equipment. The greater the number of blanks which can be produced in a single die-cutting operation, the greater the throughput of the die-cutting equipment. Since the plurality of panels 78, 80, 82, 84, and 86 for forming the drawer 28 protrude from the remainder of the blank in FIG. 3, the number of blanks which can be simultaneously formed in the cutting area of the die-cutting equipment is restricted. These drawer panels prevent a relatively large number of unitary blanks from being produced in the limited cutting area of the die-cutting equipment, thereby reducing the throughput of the die-cutting equipment.

Furthermore, during the die-cutting operation, the plurality of identical unitary blanks are separated from each other by unused portions of the paperboard sheet from which the blanks are die-cut. The drawer panels have the effect of increasing the separation between the blanks, thereby increasing the amount of unused paperboard. Since the unused paperboard is wasted, the prior art dispenser wastes a relatively large amount of paperboard during its manufacture.

After forming the unitary blank in FIG. 3, the blank is appropriately folded about its score lines and glued to create a finished, glued flat (unerected) dispenser. As part of the folding and gluing operation, the drawer panel 78 is folded 180 degrees about the lower horizontal edge of the bottom closure panel 66, and the inner surface of the drawer panel 78 is attached to the inner surface of the lower front wall portion 26. Due to the configuration of the unitary blank in FIG. 3, the operations for folding and gluing the unitary blank are time-consuming, thereby reducing the throughput of the folding and gluing equipment.

The finished, glued flat dispenser is formed into the prior art dispenser in FIGS. 1 and 2 by hand-erecting the bottom wall 22. Due to the arrangement of the drawer panels in the unitary blank in FIG. 3, the bottom wall 22 must have a hand-erect design. The illustrated bottom wall 22 is formed from the outer and inner bottom closure panels 66, 68 and the pair of bottom flaps 70, 72. Due to the labor involved in assembling the bottom wall 22 by hand, the assembly of the prior art dispenser is expensive and time-consuming. The time-consuming assembly, in turn, results in a lesser volume of production.

Therefore, a need exists for a paperboard dispenser which overcomes the aforementioned drawbacks associated with the prior art dispenser depicted in FIGS. 1–3 and described above.

SUMMARY OF THE INVENTION

In accordance with the foregoing, an object of the present invention is to provide a paperboard dispenser which is cost-effective and easy to manufacture. A related object is to provide a paperboard dispenser which maximizes the throughput of the packaging equipment, which minimizes the amount of wasted paperboard during production, and which has the ability to be manufactured with an auto-erect bottom.

In a particular embodiment, the foregoing objects are realized by providing a paperboard dispenser comprising an outer container formed from a first unitary blank and a drawer formed from a second unitary blank. The outer container includes opposing front and back walls, opposing side walls bridging the front and back walls, and a bottom wall. The front wall includes at least an upper portion spaced away from the bottom wall. The outer container is adapted to hold multiple individual items therein.

The drawer includes a front section pivotally mounted to the outer container beneath the upper portion of the front wall. The drawer further includes a pair of ears hingedly connected to opposing edges of the front section and extending into the container adjacent the respective side walls of the container. The drawer is movable from an initial closed position to an open position. In the initial closed position, the drawer is constructed and arranged to seal the container and bar access to the individual items within the container through the front wall thereof. In the open position, the individual items are accessible.

BRIEF DESCRIPTION OF THE DRAWINGS

Other objects and advantages of the invention will become apparent upon reading the following detailed description and upon reference to the drawings in which.

Figure 2:
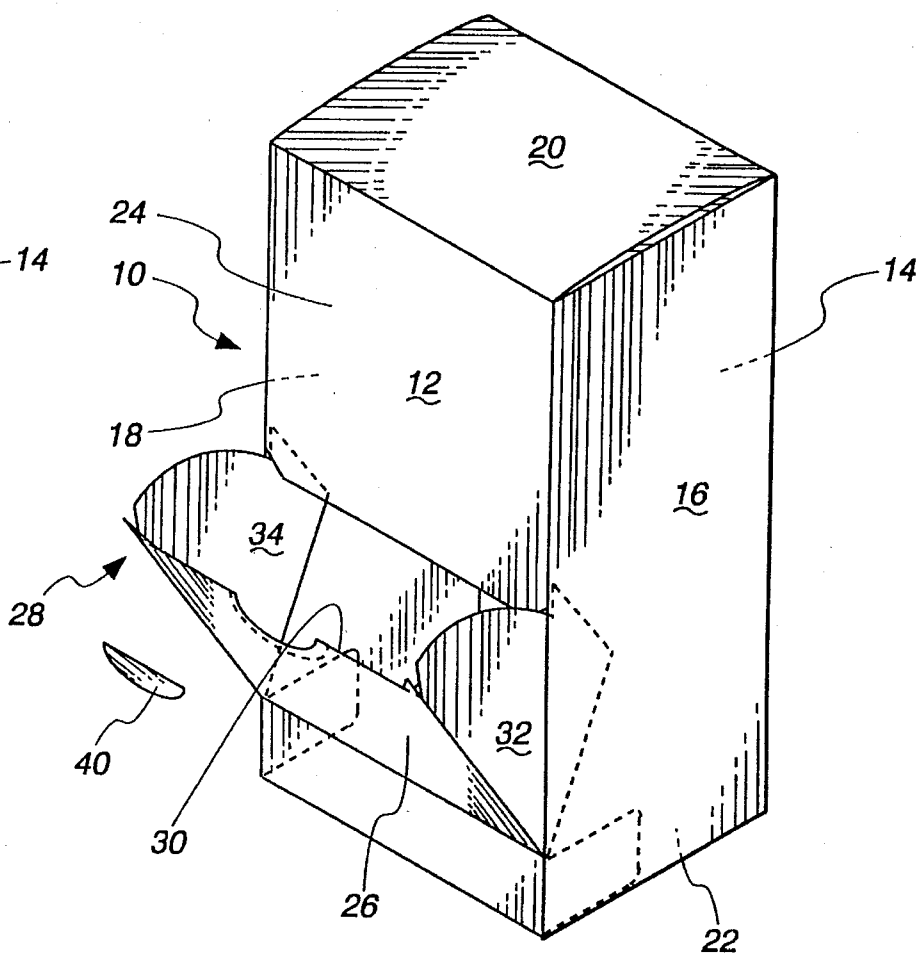
Fig. 2 PRIOR ART
FIG. 2 is a perspective view of the prior art paperboard dispenser in FIG. 1, showing the drawer in an open position.

While the invention is susceptible to various modifications and alternative forms, a specific embodiment thereof has been shown by way of example in the drawings (FIGS. 4–8) and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Figure 5:
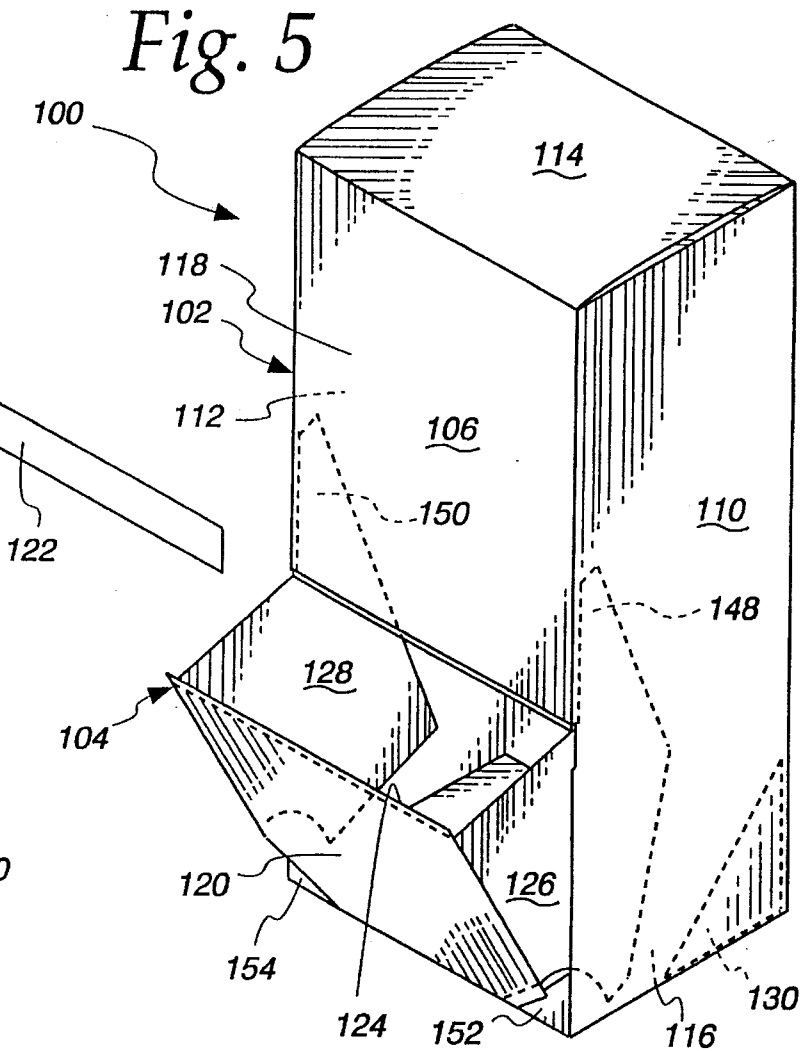
FIG. 5 is a perspective view of the paperboard dispenser in FIG. 4, showing the drawer in an open position with the tear strip removed.
Figure 4:
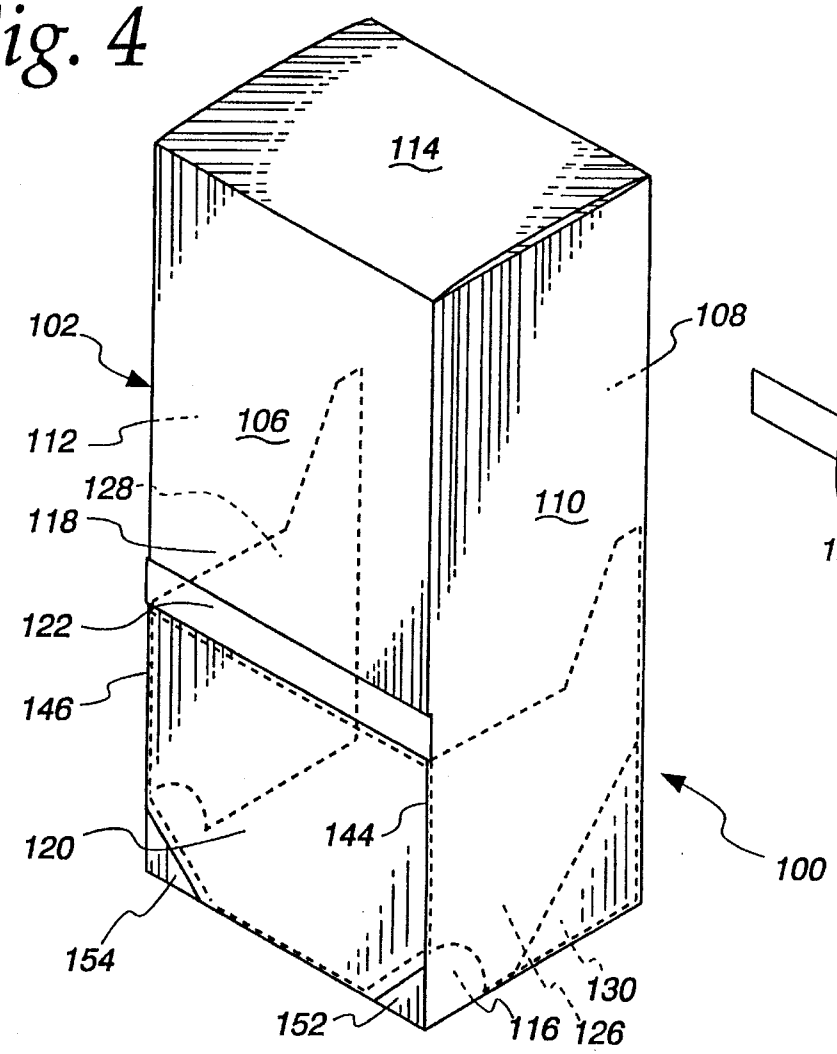
FIG. 4 is a perspective view of a paperboard dispenser embodying the present invention, showing a drawer in an initial closed position with a tear strip in place.
Figure 6:
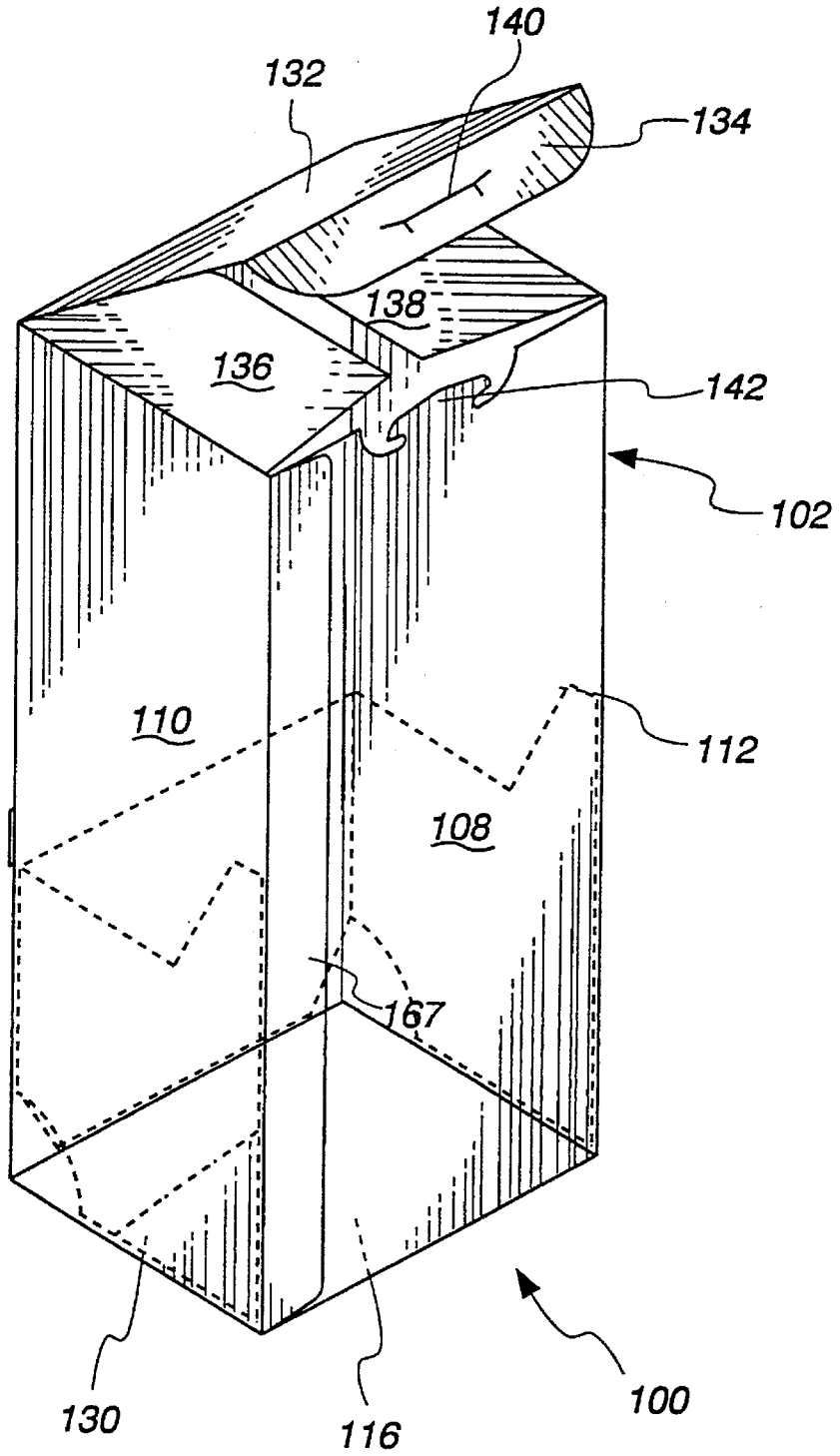
FIG. 6 is another perspective view of the paperboard dispenser in FIG. 4, showing an opened top closure.

Turning now to the drawings for the preferred embodiment of the present invention, FIGS. 4–6 illustrate an assembled paperboard dispenser 100 including an outer container 102 and a drawer 104 (FIG. 5). Hidden portions of the drawer 104 are shown by the dotted lines in FIGS. 4–6. The outer container 102 includes opposing front and back walls 106, 108, a pair of opposing side walls 110, 112, and opposing top and bottom walls 114, 116. The front wall 106 includes upper and lower portions 118, 120 separated from each other by a conventional tear strip 122. In an initial closed position of the drawer 104 (FIGS. 4 and 6), the tear strip 122 is attached to both the upper and lower portions 118, 120 of the front wall 106 by means of perforated lines so as to prevent the drawer 104 from being opened. The drawer 104 is movable from the initial closed position (FIGS. 4 and 6) to an open position (FIG. 5) so as to provide access to multiple individual items within the container 102.

The drawer 104 includes a generally rectangular front section 124 and a pair of opposing ears 126, 128 hingedly connected to the front section 124 at opposing edges thereof (FIG. 5). The outer surface of the front section 124 is attached by adhesive (e.g., glue) to the inner surface of the lower front wall portion 120 so that the front section 124 of the drawer 104 follows movement of the lower portion 120. The horizontal dimension of the front drawer section 124 is slightly smaller than the horizontal dimension of the lower front wall portion 120. The ears 126, 128 of the drawer 104 extend into the outer container 102 adjacent the respective opposing side walls 110, 112 thereof. The horizontal dimension of each ear is preferably slightly smaller than the horizontal dimension of the respective side wall. Alternatively, the horizontal dimension of each ear is equal to or slightly larger than the horizontal dimension of the respective side wall so that the back edge of each ear bears against the back wall 108 when the drawer 104 is in the closed position.

Prior to filling the container 102 with the individual items, it is important that the ears 126, 128 abut the respective side walls 110, 112 so that none of the individual items is wedged between one of the ears 126, 128 and the associated side wall. A wedged item may interfere with smooth operation of the drawer 104 and may result in the item falling out of the container 102 after opening the drawer 104. For example, referring to FIG. 5, if one or more individual items were wedged between the ear 126 and the side wall 110, opening the drawer 104 may carry the wedged item or items with the moving ear 126 such that they fall out of the container 102. To prevent the occurrence of this situation, the ear 126 is initially maintained against the side wall 110 by adhering a triangular portion 130 of the ear 126 to the inner surface of the side wall 110. The triangular portion 130 is connected to the remainder of the ear 126 by weakening nicks. The ear 128 may, if desired, be provided with a similar triangular portion which is adhered to the inner surface of the side wall 112. In the preferred embodiment, however, the hinge connection between the ear 128 and the front drawer section 124 biases the ear 128 against the side wall 112 so that such a triangular portion is not necessary to maintain the ear 128 against the side wall 112. In an alternative embodiment, the hinge connection between the ear 126 and the front drawer section 124 likewise biases the ear 126 against the side wall 110 so that the triangular portion 130 is not necessary.

Prior to filling the container 102 with the multiple items, the drawer 104 is maintained in a closed position by virtue of a detachable connection between the lower front wall portion 120 and adjacent portions of the container 102. The opposing vertical edges of the lower front wall portion 120 are detachably connected to the respective side walls 110, 112 by respective perforated hinges 144, 146. Also, the upper horizontal edge of the lower portion 120 is detachably connected to the tear strip 122.

The container 102 of the dispenser 100 is filled by hand or automated equipment through either the top wall 114 or the bottom wall 116. Alternatively, the container 102 may be formed such that its is filled through one of the side walls 110, 112. In the preferred embodiment, the top wall 114 is a conventional tuck closure with a spear tab lock (FIG. 6). More specifically, the top wall 114 is formed from a top closure panel 132, a top tuck flap 134, and a pair of dust flaps 136, 138. The top closure panel is hingedly connected to the upper horizontal edge of the front wall 106, and the pair of dust flaps 136, 138 are hingedly connected to the upper horizontal edges of the respective side walls 110, 112. To form the top wall 114, the dust flaps 136, 138 are folded inward beneath the top closure panel 132, the top closure panel 132 is folded over the dust flaps 136, 138, and the tuck flap 134 is inserted between the dust flaps 136, 138 and the inner surface of the back wall 108. To strengthen the top closure so that it can withstand substantial abuse without disengaging, the tuck flap 134 is provided with a lock slit 140 adapted to engage with a spear lock tab 142 extending from the back wall 108. Alternatively, the top wall 114 may be formed from other conventional closure designs, including but not limited to a friction lock tuck closure, a slit (pie) lock tuck closure, a slit lock tuck/edge lock closure (i.e., "Mailer Lock"), a standard tuck and tongue closure, a bellows (gusset) tuck and tongue closure, a friction tuck/locking dust flap combination closure, a slit lock tuck/locking dust flap combination closure, a full or partial panel seal end closure, or a slit lock tab closure with the lock tab extending from an outer top closure panel and a slit located in a hinge between the inner top closure panel and the back wall. Furthermore, the top wall 114 may be removed completely so that the container 102 is filled with individual items through an open top end.

The bottom wall 116 is preferably a conventional "Himes" lock (i.e., crash lock or popcorn bottom). The construction and erection process for forming the bottom wall 116 is described below in connection with the description of the container blank in FIG. 7. Alternatively, the bottom wall 116 may be formed from other bottom closure designs, including but not limited to a slit lock tuck closure, a slit lock tuck/edge lock closure, a tuck and tongue closure, a bellows (gusset) tuck and tongue closure, a slit lock tuck/locking dust flap combination closure, a full or partial panel seal end closure, a slit lock tab closure, a non-glued/interlocked flap closure (i.e., "Houghland" closure or 1-2-3 closure), a non-glued quad lock closure (i.e., double lock or ear hook closure), a preglued full-flap automatic closure, or a preglued infold automatic closure. The foregoing conventional closure designs for both the top wall 114 and the bottom wall 116 are described and illustrated in the "Handbook of Folding Carton Style Nomenclature" published by the Paperboard Packaging Council of Washington, D.C.

After filling the container 102 with the multiple items through either the top wall 114 or the bottom wall 116, the opened container end is closed. After the dispenser 100 has reached its destination for display, such as a convenience store, grocery store, or home pantry, the drawer 104 is opened as follows. First, the tear strip 122 is removed by tearing or pulling away the tear strip 122 so as to effectively disengage the upper and lower portions 118, 120 of the front wall 106. The interior of the container 102 is revealed where the tear strip 122 has been removed. The design of the tear strip 122 and its operation in effective sealing and convenient tearing-open of the dispenser 100 of the type disclosed herein is conventional and, accordingly, is not described in detail herein. It suffices to say that the tear strip 122 is substantially in the form of a pair of parallel horizontal perforated lines having a predefined depth of cut (at least about 30 percent) into the outer side of the front wall 106. A reinforcing tape (not shown) may be attached to the inner surface of the tear strip 122 to prevent the strip from breaking apart as a result of the strip being removed from the front wall 106 during the unsealing operation.

Next, the user pulls the attached lower front wall portion 120 and front drawer section 124 outward in a direction away from the interior of the container 102. The outward pressure causes the weakening nicks between the triangular portion 130 and the remainder of the ear 126 to rupture and causes the perforated hinges 144, 146 to rupture, thereby permitting the drawer 104 and the lower front wall portion 120 to pivot about the lower horizontal edge of the lower portion 120. It should be apparent that the lower front wall portion 120 remains hingedly connected to the bottom wall 116 following the removal of the tear strip 122 and the rupturing of the perforated hinges 144, 146.

The application of continued outward force to the drawer 104 causes the drawer 104 to move to the open position (FIG. 5). To strictly confine the drawer 104 to the illustrated open position and prevent any movement beyond that open position, the ears 126, 128 are provided with respective stoppers 148, 150. Once the drawer 104 reaches the open position, the stoppers 148, 150 contact the inner surface of the upper front wall portion 118. Without the stoppers 148,

150, the drawer 104 is still prevented from opening beyond a certain point by the upper edges of the ears 126, 128. The stoppers 148, 150, however, allow for stricter confinement of the outward movement of the drawer 104.

As best shown in FIGS. 4 and 5, the lower front wall portion 120 includes a pair of right-angled triangular sections 152, 154 which aid in preventing the items within the container 102 from escaping the container 102. These triangular sections 152, 154 are connected to the respective side walls 110, 112 and to the bottom wall 116 and are disconnected from the remainder of the lower front wall portion 120. Therefore, the triangular sections 152, 154 remain stationary while the drawer 104 is opened. To permit the ears 126, 128 to freely move relative to the respective triangular sections 152,154, the lower front ends of the ears 126, 128 are configured in the shape of quarter circles. As the drawer 104 moves to the open position, these quarter-circular front ends accommodate the triangular sections 152, 154 (FIG. 5). Furthermore, to prevent interference between the front drawer section 124 and the triangular sections 152, 154 while the drawer 104 is opened, the front drawer section 124 is provided with 45 degree-angled lower corners so that the front drawer section 124 substantially matches the lower front wall portion 120 minus the triangular sections 152, 154 (FIG. 4). In other words, the front drawer section 124 does not bear against the triangular sections 152, 154.

Figures 7, 8:
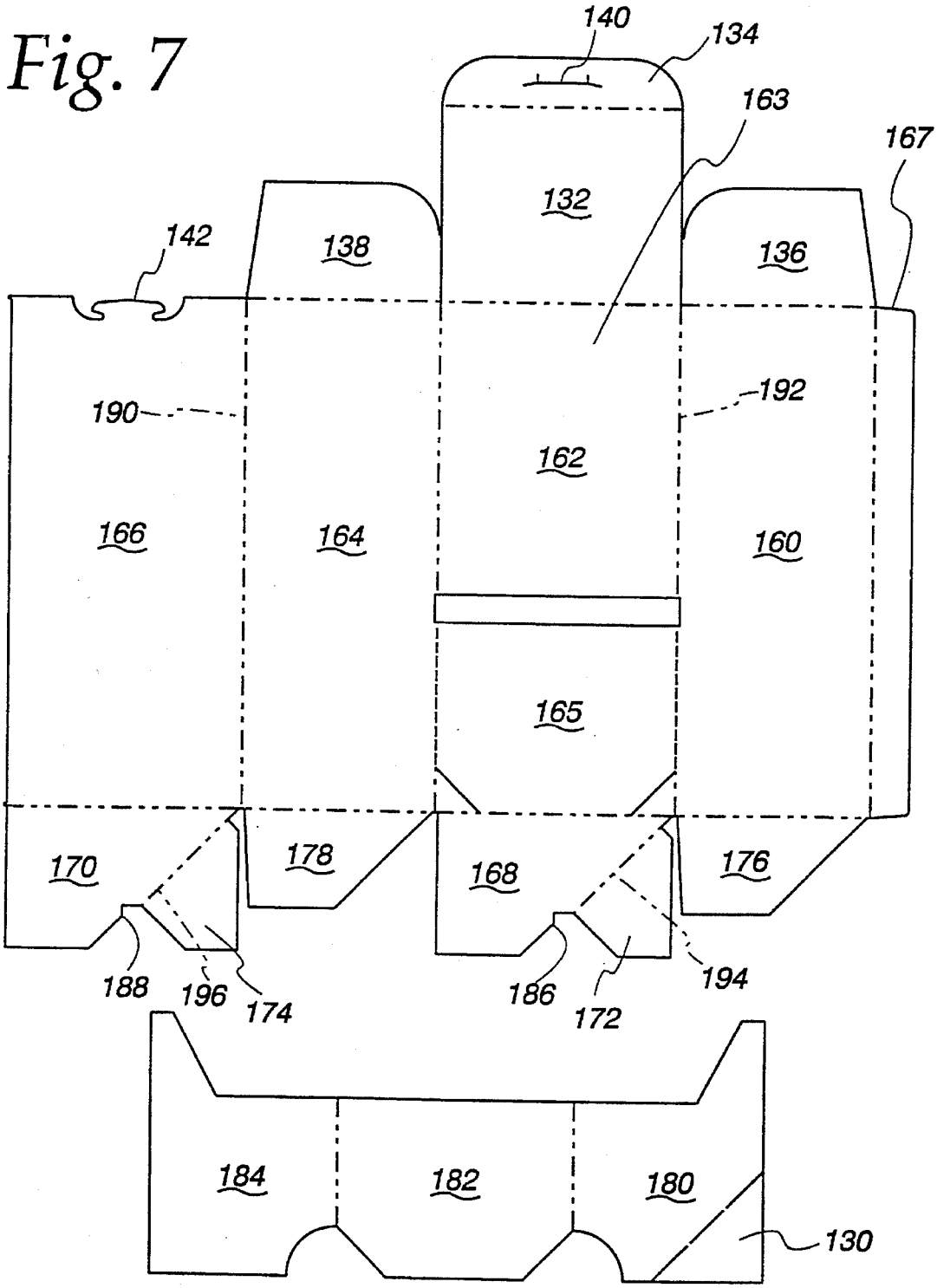
FIG. 7 is a plan view of the outside surface of a first unitary paperboard blank used to form the outer container of the paperboard dispenser in FIG. 4.
FIG. 8 is a plan view of the outside surface of a second unitary paperboard blank used to form the drawer of the paperboard dispenser in FIG. 4.

The paperboard dispenser 100 in FIGS. 4–6 is formed from the unitary container blank in FIG. 7 and the unitary drawer blank in FIG. 8. The container blank includes four main panels 160, 162, 164, and 166 hingedly connected to each other along parallel vertical score lines. With respect to the container 102, the panel 160 corresponds to the side wall 110, the panel 162 corresponds to the front wall 106, the panel 164 corresponds to the side wall 112, and the panel 166 corresponds to the back wall 108. The tear strip 122 extends across the front panel 162 to divide that front panel 162 into an upper front panel 163 and a lower front panel 165. The upper and lower front panels 163, 165 correspond to the respective upper and lower front wall portions 118, 120 of the formed container 102. A glue flap 167 is hingedly connected to the right vertical edge (as viewed in FIG. 7) of the side panel 160.

The top closure panel 132 with the top tuck flap 134 is hingedly connected to the upper horizontal edge of the front panel 162, and the pair of dust flaps 136, 138 are hingedly connected to the upper horizontal edges of the respective side panels 160, 164. The dust flaps 136, 138 and the top closure panel 132 with the top tuck flap 134 form the top wall 114 of the container 102. In the container 102 generated from the blank in FIG. 7, the lock slit 140 in the tuck flap 134 is adapted to engage with the spear lock tab 142 located at the upper horizontal edge of the back panel 166. Bottom closure panels 168, 170 with respective glue tabs 172, 174 are hingedly connected to the lower horizontal edges of the respective front and back panels 162, 166, and closure flaps 176, 178 are hingedly connected to the lower horizontal edges of the respective side panels 160, 164. These bottom closure panels and flaps cooperate, by implementation of a "Himes" lock, to form the bottom wall 116 of the container 102 in the manner described below.

The drawer 104 is formed from the blank depicted in FIG. 8. The drawer blank includes three main panels 180, 182, and 184 hingedly connected to each other along parallel vertical score lines. With respect to the drawer 104, the panels 180, 184 correspond to the respective ears 126, 128, and the panel 182 corresponds to the front drawer section 120. The ear panel 180 includes the triangular portion 130.

During the manufacturing process, a sheet of paperboard is die-cut and scored to simultaneously produce a plurality of identical container and drawer blanks which, in turn, are formed into a plurality of dispensers 100. Since the container 102 and the drawer 104 are formed from separate unitary blanks and since these blanks have a regular (non-erratic) shape, the number of container and drawer blanks which can be simultaneously formed in the limited cutting area of the die-cutting equipment is maximized. This, in turn, maximizes the throughput of the die-cutting equipment. Furthermore, during the die-cutting operation, the regular (non-erratic) configuration of the container and drawer blanks allows the blanks to be formed in close proximity to each other with only a small amount of unused paperboard separating the blanks from each other. Therefore, the amount of paperboard wasted during the die-cutting operation is minimized.

To form the dispenser 100 from the container blank in FIG. 7 and the drawer blank in FIG. 8, conventional automated equipment (i.e., an inlet spotter) is first used to apply adhesive (e.g., glue) to the outer surfaces of the front drawer panel 182 and the triangular portion 130 of the side drawer panel 180. Next, the automated equipment positions the drawer blank relative to the container blank such that the outer surfaces of the drawer panels 180, 182, and 184 are adjacent the inner surfaces of the respective container panels 160, 162, and 164. In the foregoing manner, the outer surface of the front drawer panel 182 is attached to the inner surface of the lower front panel 165 of the container blank, and the outer surface of the triangular portion 130 is attached to the inner surface of the lower end of the side panel 160. Unlike the process for folding and gluing the drawer panels of the prior art blank in FIG. 3 to produce the prior art dispenser in FIGS. 1–2, the above operation of attaching the drawer blank to the container blank takes a relatively small amount of time, thereby maximizing the throughput of the automated equipment.

After automatically positioning and attaching the drawer blank to the container blank, blanks are appropriately folded about their working score lines and glued to create a finished, glued flat (unerected) dispenser. In particular, using conventional automated equipment, the bottom closure panels 168, 170 and flaps 176, 178 are folded 180 degrees about their respective upper edges (as viewed in FIG. 7) so that the inner surface of the closure panel 168 abuts the inner surface of the front drawer panel 182, the inner surface of the closure panel 170 abuts the inner surface of the back panel 166, the inner surface of the flap 176 abuts the inner surface of the ear panel 180 , and the inner surface of the flap 178 abuts the inner surface of the ear panel 184. The glue tab 172 of the closure panel 168 is folded 180 degrees about the working score 194 such that the outer surface of the glue tab 172 abuts the outer surface of the remainder of the closure panel 168. Similarly, the glue tab 174 is folded 180 degrees about the working score 196.

Next, the back panel 166 is folded 180 degrees downwardly and inwardly (as viewed in FIG. 7) about the working score 190, and the side panel 160 of the container blank is folded 180 degrees downwardly and inwardly about the working score 192. With adhesive applied to the glue flap 167 and the glue tabs 172, 174, the above folding operation attaches the inner surface of the glue flap 167 to the outer surface of the back panel 166 and attaches the inner surfaces of the glue tabs 172, 174 to the outer surfaces of the respective bottom closure flaps 176, 178. The dispenser is now in finished, glued flat form. The aforementioned manufacturing process for producing the flat dispenser is implemented with automated equipment.

To erect the flat dispenser, the bottom wall 116 is erected by engaging a locking portion 186 of the bottom closure panel 168 in conventional fashion with a locking portion 188 of the bottom closure panel 170. Since the bottom wall 116 is implemented with the "Himes" lock, the bottom wall 116 is erected by hand. Alternatively, however, the bottom wall 116 may be formed from other closure designs which are erected solely with automated equipment. Unlike the prior art blank in FIG. 3 for forming the prior art dispenser in FIGS. 1–2, the drawer blank in FIG. 8 does not dictate the use of a hand-erected bottom wall.

While the present invention has been described with reference to one or more particular embodiments, those skilled in the art will recognize that many changes may be made thereto without departing from the spirit and scope of the present invention.

Figure 1:
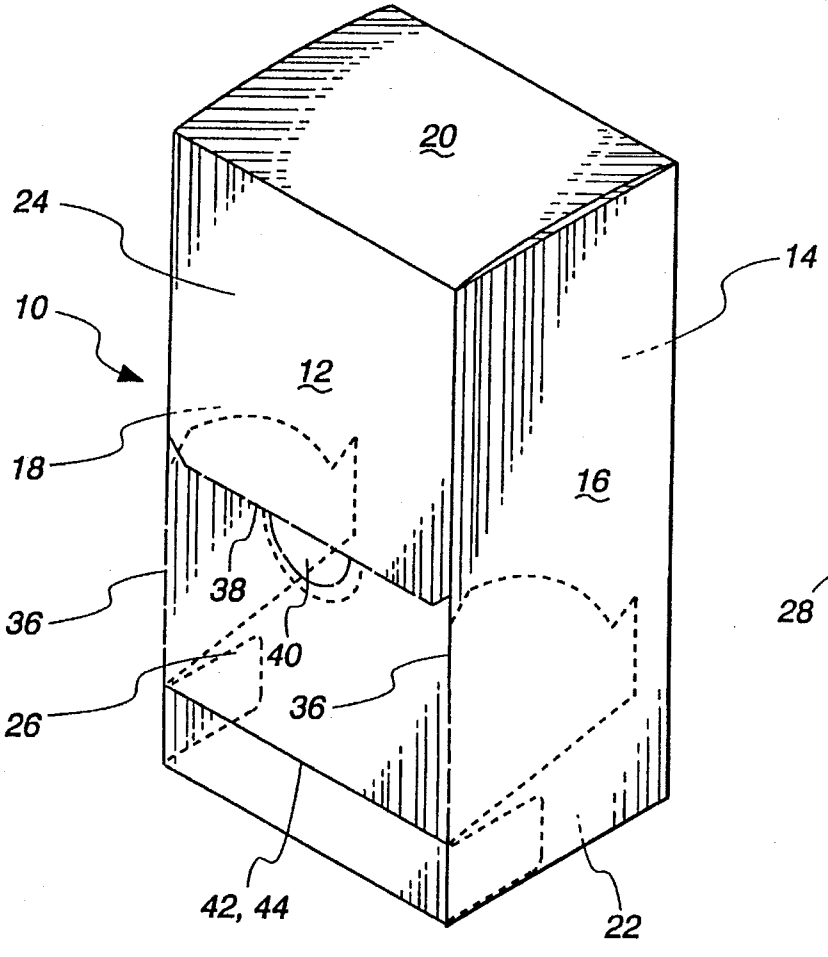
Fig. 1 PRIOR ART
FIG. 1 is a perspective view of one type of prior art paperboard dispenser, showing a drawer in an initial closed position.
Figure 3:
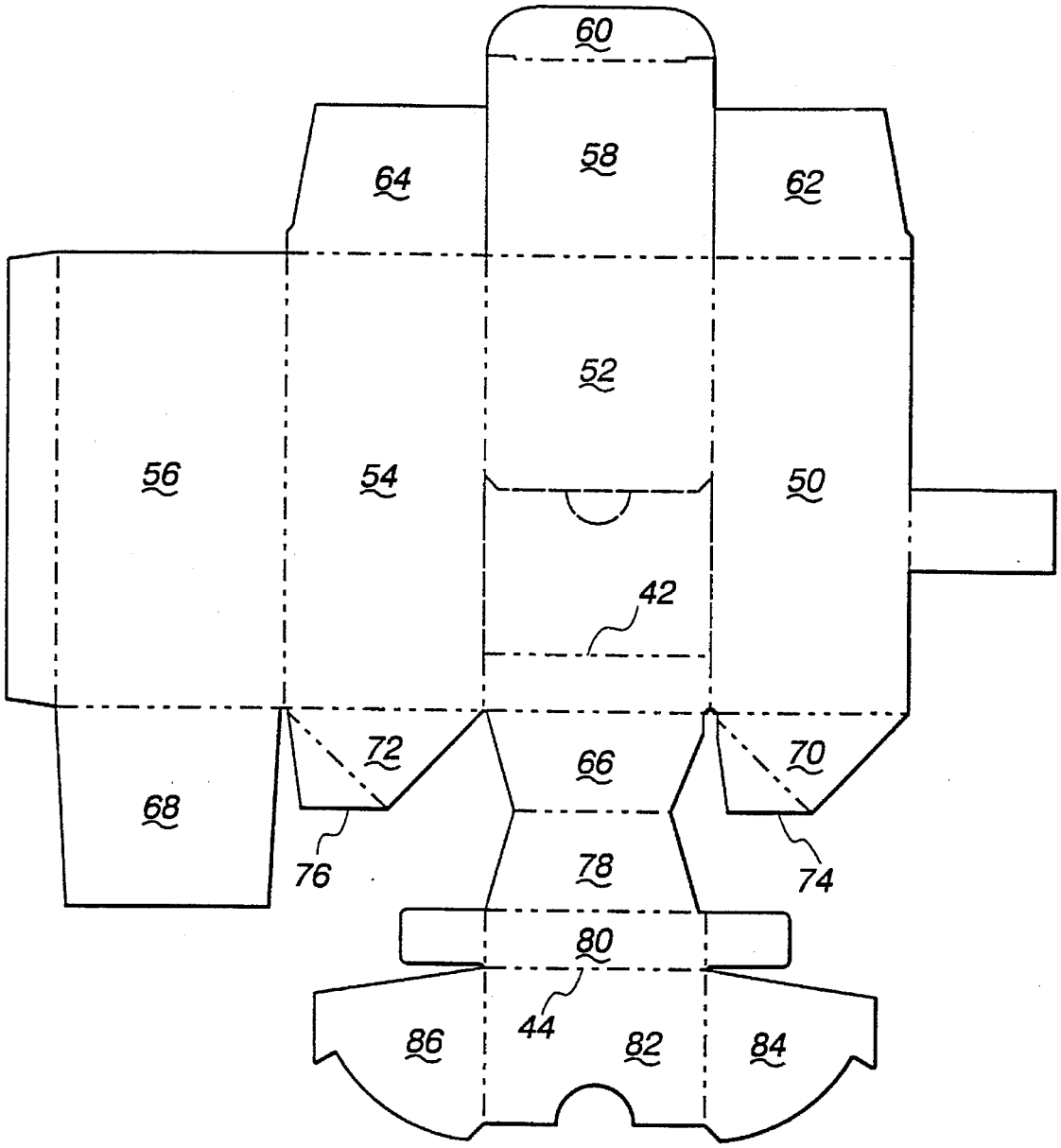
Fig. 3 PRIOR ART
FIG. 3 is a plan view of the outside surface of a unitary paperboard blank used to form the prior art paperboard dispenser in FIG. 1.

For example, in one alternative embodiment, the tear strip 122 is substituted with perforations like the perforations 38 of the prior art dispenser in FIGS. 1–2. In another alternative embodiment, the perforations are removed so that the upper horizontal edge of the lower front wall portion 120 is disconnected from the lower horizontal edge of the upper front wall portion 118, even in the initial closed position of the drawer 104. The drawer 104 is maintained in the initial closed position by the perforations 144, 146 along the vertical edges of the lower front wall portion 120 and by the attachment of the triangular portion 130 of the ear 126 to the side wall 110.

In yet another alternative embodiment, the lower front wall section 120 is substantially removed to effect a paperboard savings and the height of the front drawer section 124 is increased to extend above the lower horizontal edge of the upper front wall portion 118 adjacent the outer surface of the upper portion 118. By increasing the height of the front drawer section 124, the front drawer section prevents access to the container through the front wall thereof prior to opening the drawer. Although the drawer of the modified dispenser is not pivotally hinged to the container to facilitate the opening of the drawer, the drawer still tends to pivot about the lower front edge thereof because the drawer is opened by pulling outward on the upper horizontal edge of the front drawer section. While applying outward force to the upper horizontal edge of the front drawer section, the lower horizontal edge thereof tends to remain stationary, thereby causing the drawer to pivot about the lower horizontal edge of the front drawer section. To insure that the lower horizontal edge of the front drawer section does not slip out of the container while opening the drawer, the container front wall may be provided with a lower lip akin to the strip panel below the horizontal score 42 in FIGS. 1–2.

In a further embodiment, the drawer 104 of the dispenser 100 is modified to include a partial or full back panel opposing the front drawer section 124 and connected to one or both of the ears 126, 128. The drawer 104 may also be modified to include a bottom panel overlapping the bottom wall 116 of the container 102.

Each of these embodiments and obvious variations thereof is contemplated as falling within the spirit and scope of the claimed invention, which is set forth in the following claims.

What is claimed is:

1. A paperboard dispenser, comprising:

an outer container formed from a first unitary paperboard blank and adapted to hold multiple individual items therein, said container having opposing front and back walls, opposing side walls bridging said front and back walls, and a bottom wall, said front wall including an upper portion and a lower portion, said lower portion being pivotally connected to said container; and a bottomless drawer formed from a second unitary paperboard blank and movable between an initial closed position and an open dispensing position, said drawer including a front section disposed substantially parallel to said front wall and pivotally movable relative to said container beneath said upper portion of said front wall, said lower portion of said front wall of said container having an inner surface disposed adjacent to an outer surface of said front section of said drawer, said drawer further including a pair of ears hingedly connected to opposing edges of said front section and extending into said container adjacent respective ones of said opposing side walls of said container.

2. The paperboard dispenser of claim 1, further including means for releasably maintaining said drawer in said initial closed position.

3. The paperboard dispenser of claim 2, wherein said lower portion is generally rectangular in shape and includes a pair of opposing vertical edges and opposing upper and lower horizontal edges, and wherein said means for releasably maintaining said drawer in said initial closed position includes perforations between said pair of opposing vertical edges and said respective side walls.

4. The paperboard dispenser of claim 3, wherein said means for releasably maintaining said drawer in said initial closed position includes means for detachably connecting said upper horizontal edge of said lower portion to a lower horizontal edge of said upper portion.

5. The paperboard dispenser of claim 4, wherein said means for detachably connecting said upper horizontal edge of said lower portion to a lower horizontal edge of said upper portion includes a horizontal tear strip.

6. The paperboard dispenser of claim 4, wherein said means for detachably connecting said upper horizontal edge of said lower portion to a lower horizontal edge of said upper portion includes perforations.

7. The paperboard dispenser of claim 2, wherein one of said pair of ears includes a primary portion and a secondary portion, and wherein said means for releasably maintaining said drawer in said initial closed position includes a detachable connection of an outer surface of said secondary portion to an inner surface of said respective side wall in said initial closed position of said drawer such that moving said drawer to said open position detaches said secondary portion from said primary portion.

8. The paperboard dispenser of claim 1, wherein one of said pair of ears includes a primary portion and a secondary portion detachably connected to said primary portion in said initial closed position of said drawer, said secondary portion having an outer surface attached to an inner surface of said respective side wall of said container such that moving said drawer to said open position detaches said secondary portion from said primary portion.

9. The paperboard dispenser of claim 1, wherein said container further includes a top wall opposing said bottom wall.

10. The paperboard dispenser of claim 1, wherein said pair of ears includes respective stoppers constructed and arranged to contact an inner surface of said upper portion of said front wall in response to said drawer moving to said open position.

11. The paperboard dispenser of claim 1, wherein said lower portion of said front wall is hingedly connected to said bottom wall along a horizontal score line, and wherein said lower portion pivotally moves about said horizontal score line as said drawer moves from said initial closed position to said open position.

12. A paperboard dispenser, comprising:

an outer container formed from a first unitary paperboard blank and adapted to hold multiple individual items therein, said container having opposing front and back walls, opposing side walls bridging said front and back walls, and a bottom wall, said front wall including an upper portion and a lower portion, said lower portion hingedly connected to said container along a horizontal score line;

a bottomless drawer formed from a second unitary paperboard blank and movable between an initial closed position where said drawer is housed within said outer container and an open dispensing position, said drawer including a front section having an outer surface attached to an inner surface of said lower portion of said front wall so that said lower portion hingedly moves about said horizontal score line as said drawer moves from said initial closed position to said open position, said drawer further including a pair of ears hingedly connected to opposing edges of said front section and extending into said container adjacent respective ones of said opposing side walls of said container; and means for releasably maintaining said drawer in said initial closed position.

13. The paperboard dispenser of claim 12, wherein one of said pair of ears includes a primary portion and a secondary portion detachably connected to said primary portion in said initial closed position of said drawer, said secondary portion having an outer surface attached to an inner surface of said respective side wall of said container such that moving said drawer to said open position detaches said secondary portion from said primary portion.

14. The paperboard dispenser of claim 12, wherein said container further includes a top wall opposing said bottom wall.

15. The paperboard dispenser of claim 12, wherein said pair of ears includes respective stoppers constructed and arranged to contact an inner surface of said upper portion of said front wall in response to said drawer moving to said open position.

16. A paperboard dispenser, comprising:

an outer container formed from a first unitary blank and adapted to hold multiple individual items therein, said container having opposing front and back walls, opposing side walls bridging said front and back walls, and a bottom wall, said front wall including at least an upper portion spaced away from said bottom wall; and a drawer formed from a second unitary blank and movable between an initial closed position and an open dispensing position, said drawer including a front section disposed substantially parallel to said front wall and pivotally movable relative to said container beneath said upper portion of said front wall, said drawer further including a pair of ears hingedly connected to opposing edges of said front section and extending into said container adjacent respective ones of said opposing side walls of said container, one of said pair of ears including a primary portion and a secondary portion detachably connected to said primary portion in said initial closed position of said drawer, said secondary portion having an outer surface attached to an inner surface of said respective side wall of said container such that moving said drawer to said open position detaches said secondary portion from said primary portion.

* * * * *